US007655133B2

(12) United States Patent
Loh et al.

(10) Patent No.: US 7,655,133 B2
(45) **Date of Patent: *Feb. 2, 2010**

(54) ASHLESS HYDRAULIC FLUID OR PAPER MACHINE OIL

(75) Inventors: William Loh, Petaluma, CA (US); John M. Rosenbaum, Richmond, CA (US); Nancy J. Bertrand, Lafayette, CA (US); Patricia LeMay, Vallejo, CA (US); Rawls H. Frazier, Petaluma, CA (US); Mark E. Okazaki, Alameda, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/323,205

(22) Filed: Nov. 25, 2008

(65) Prior Publication Data

US 2009/0075850 A1 Mar. 19, 2009

Related U.S. Application Data

(62) Division of application No. 11/316,310, filed on Dec. 21, 2005, now Pat. No. 7,547,666.

(51) Int. Cl.
*C10L 1/22* (2006.01)
*C10G 71/00* (2006.01)

(52) U.S. Cl. ..... 208/18; 208/19; 508/192

(58) Field of Classification Search ..... 508/192, 508/460; 208/18, 19
See application file for complete search history.

(56) References Cited

U.S. PATENT DOCUMENTS 6,103,099 A 8/2000 Wittenbrink
6,251,840 B1 6/2001 Ward et al.
7,045,055 B2 5/2006 Ziemer et al.
7,195,706 B2 3/2007 Abernathy et al.
7,282,134 B2 10/2007 Abernathy et al.
7,435,327 B2 10/2008 Rosenbaum et al.
2004/0053794 A1* 3/2004 Baba ..... 508/430
2006/0293193 A1 12/2006 Rosenbaum et al.
2007/0093396 A1 4/2007 Okazaki

FOREIGN PATENT DOCUMENTS

WO WO00/14183 3/2000

OTHER PUBLICATIONS

U.S. Appl. No. 11/296,636, "Manual Transmission Fluid Made With Lubricating Base Oil High Monocycloparaffins and Low Multicycloparaffins." Rosenbaum et al., filed Dec. 7, 2005.

* cited by examiner

*Primary Examiner*—Walter D Griffin
*Assistant Examiner*—Frank C Campanell
(74) *Attorney, Agent, or Firm*—Susan M. Abernathy

(57) ABSTRACT

An ashless lubricating oil, comprising a base oil having greater than 90 wt % saturates, less than 10 wt % aromatics, a viscosity index greater than 130, low sulfur, and a sequential number of carbon atoms. The lubricating oil has a VI between 155 and 300, greater than 680 minutes in a rotary pressure vessel oxidation test, and a kinematic viscosity at 40° C. from 19.8 to 748 cSt. An ashless paper machine oil, comprising a base oil having a sequential number of carbon atoms, wherein the oil has a defined viscosity index and high oxidation stability. Also, an ashless lubricating oil, comprising a base oil having a viscosity index greater than 150, wherein the base oil is made from a blend of petroleum-based wax and Fischer-Tropsch derived wax.

16 Claims, No Drawings

ASHLESS HYDRAULIC FLUID OR PAPER MACHINE OIL

This application is a division of prior application Ser. No. 11/316,310, now U.S Pat. No. 7,547,666, filed Dec. 21, 2005.

FIELD OF THE INVENTION

This invention is directed to ashless hydraulic fluids and ashless paper machine oils having a high viscosity index and excellent oxidation stability, a process for making ashless hydraulic fluid and ashless paper machine oil with superior oxidation stability, and a method for improving the oxidation stability of an ashless hydraulic fluid or ashless paper machine oil.

BACKGROUND OF THE INVENTION

WO 00/14183 and U.S. Pat. No. 6,103,099 to ExxonMobil teach a process for producing an isoparaffinic lubricant base stock which comprises hydroisomerizing a waxy, paraffinic, Fischer-Tropsch synthesized hydrocarbon feed comprising 650-750° F.+ hydrocarbons, said hydroisomerization conducted at a conversion level of said 650-750° F.+ feed hydrocarbons sufficient to produce a 650-750° F.+ hydroisomerate base stock which comprises said base stock which, when combined with at least one lubricant additive, will form a lubricant meeting desired specifications. Hydraulic oils are claimed, but nothing is taught regarding processes to make or compositions of lubricating oils having excellent oxidation stability.

Conoco ECOTERRA™ Hydraulic Fluid is formulated with high quality hydrocracked base oils and fortified with an ashless, zinc-free antiwear additive package. It has a high oxidation stability, such that the ISO 32 grade has a result of 700 minutes in the rotary pressure vessel oxidation test (RPVOT) by ASTM D 2272 at 150° C. The ISO 46 grade has a result of 685 minutes, and the ISO 68 grade has a result of 675 minutes. Conoco ECOTERRA™ Hydraulic Fluid, however has a low viscosity index of about 102 or less.

PetroCanada PURITY™ FG AW Hydraulic Fluids have RPVOT results of between 884 and 888 minutes, but they too only have viscosity indexes of about 102 or less.

PetroCanada HYDREX SUPREME™ is an ISO 32 hydraulic fluid with a RPVOT result of about 1300 minutes. HYDREX SUPREME™ is a trademark of PetroCanada. The base oil in this product is a highly refined water-white base oil. The base oil used in the PetroCanada HYDREX SUPREME™ hydraulic fluid does not have a viscosity index that is exceptionally high, and the base oil is available in limited quantities. It is blended with a significant amount of viscosity index improver to provide it with a viscosity index of about 353. Additionally, hydraulic fluids having high viscosity indexes and good oxidation stabilities have been made from synthetic base oils, and also from high oleic base oils made from vegetable oils. These types of base oils, however, are expensive and not available in large quantities.

What is desired is a lubricating oil having excellent oxidation stability and high viscosity index made using a base oil having greater than 90 wt % saturates, less than 10 wt % aromatics, a viscosity index greater than 120, less than 0.03 wt % sulfur and a sequential number of carbon atoms, without the inclusion of high levels of viscosity index improvers; and a process to make it.

SUMMARY OF THE INVENTION

We have discovered an ashless lubricating oil, made from a base oil having: greater than 90 wt % saturates, less than 10 wt % aromatics, a base oil viscosity index greater than 120, less than 0.03 wt % sulfur and a sequential number of carbon atoms; wherein the ashless lubricating oil has a lubricating oil viscosity index between 155 and 300, a result of greater than 680 minutes in the rotary pressure vessel oxidation test by ASTM D 2272-02, and a kinematic viscosity at 40° C. from 19.8 cSt to 748 cSt; and wherein the ashless lubricating oil is a hydraulic fluid or a paper machine oil.

We have also discovered an ashless hydraulic fluid or ashless paper machine oil, comprising:

a) a base oil having: greater than 90 wt % saturates, less than 10 wt % aromatics, a viscosity index greater than 120, less than 0.03 wt % sulfur, a sequential number of carbon atoms, and greater than 35 wt % total molecules with cycloparaffinic functionality or a traction coefficient less than or equal to 0.021 when measured at a kinematic viscosity of 15 cSt and at a slide to roll ratio of 40 percent;

b) an ashless antioxidant additive concentrate; and c) less than 0.5 wt % based on the total lubricating oil of a viscosity index improver;

wherein the ashless hydraulic fluid or ashless paper machine oil has a viscosity index greater than 155 and a result of greater than 600 minutes in the rotary pressure vessel oxidation test by ASTM D 2272-02 at 150° C.

Additionally, we have discovered an ashless hydraulic fluid or ashless paper machine oil comprising:

a) between 1 and 99.8 weight percent based on the total lubricating oil of a base oil having greater than 90 wt % saturates, less than 10 wt % aromatics, a base oil viscosity index greater than 150, less than 0.03 wt % sulfur, a sequential number of carbon atoms, and greater than 35 wt % total molecules with cycloparaffinic functionality or a traction coefficient less than or equal to 0.021 when measured at a kinematic viscosity of 15 cSt and at a slide to roll ratio of 40 percent;

b) between 0.05 and 5 weight percent based on the total lubricating oil of an ashless antioxidant additive concentrate, and c) less than 0.5 weight percent based on the total lubricating oil of a viscosity index improver;

wherein the ashless hydraulic fluid or ashless paper machine oil has a lubricating oil viscosity index greater than 155 and a result of greater than 600 minutes in the rotary pressure vessel oxidation test by ASTM D 2272-02 at 150° C.

We have also invented a process for making an ashless hydraulic fluid or ashless paper machine oil with high oxidation stability. The process for making an ashless hydraulic fluid or ashless paper machine oil comprises:

a) hydroisomerization dewaxing a waxy feed having greater than 60 wt % n-paraffins and less than 25 ppm total combined nitrogen and sulfur to make a base oil having greater than 90 wt % saturates, less than 10 wt % aromatics, a base oil viscosity index greater than 120, less than 0.03 wt % sulfur and a sequential number of carbon atoms;

b) fractionating the base oil into different viscosity grades of base oil, c) selecting one or more of the different viscosity grades of base oil having a selected base oil viscosity index greater than 150, and greater than 35 wt % molecules with cycloparaffinic functionality or a traction coefficient less than or equal to 0.021, and d) blending the selected one or more of the different viscosity grades of base oil with an ashless antioxidant additive concentrate to make the ashless hydraulic fluid or ashless paper machine oil;

wherein the ashless hydraulic fluid or ashless paper machine oil has a viscosity index between 155 and 300 and a result of greater than 680 minutes in the rotary pressure vessel oxidation test by AST D 2272-02 at 150° C.

We have also developed a new method for improving the oxidation stability of an ashless hydraulic fluid or an ashless paper machine oil, comprising:

a) selecting a base oil having greater than 90 wt % saturates, less than 10 wt % aromatics, a base oil viscosity index greater than 120, less than 0.03 wt % sulfur, a sequential number of carbon atoms, greater than 35 wt % total molecules with cycloparaffinic functionality or a traction coefficient less than or equal to 0.021 when measured at a kinematic viscosity of 15 cSt and at a slide to roll ratio of 40 percent, and a ratio of molecules with monocycloparaffinic functionality to molecules with multicycloparaffinic functionality greater than 2.1; and b) replacing a portion of the base oil in the ashless hydraulic fluid or ashless paper machine oil with the selected base oil to produce an improved ashless lubricating oil;

wherein the improved ashless lubricating oil has a result in the rotary pressure vessel oxidation test by ASTM D 2272-02 at 150° C. that is at least 50 minutes greater than the result in the rotary pressure vessel oxidation test of the ashless hydraulic fluid or ashless paper machine oil.

DETAILED DESCRIPTION OF THE INVENTION

Hydraulic fluids and circulating oils with excellent oxidation stability and high viscosity indexes are highly desired. Excellent oxidation stability translates into longer oil life, extending time between oil changes and thereby reducing downtime costs. Excellent oxidation stability also minimizes sludge build-up and reduces harmful varnish deposits, ensuring smooth reliable operation.

Several types of hydraulic and circulating oil equipment are required to operate under extreme high and low temperature conditions. To accommodate wide-ranging environmental conditions, lubricating oils with high viscosity indexes are needed. In the past, high viscosity indexes were achieved by including viscosity index (VI) improvers. Increasingly, smaller hydraulic pumps are being designed to run at higher pressures. Higher pressures give rise to higher temperatures, increasing oxidative degradation of the lubricating oil, and potentially more shearing of any VI improvers in the lubricating oil.

The lubricating oil of this invention comprises a viscosity index between 155 and 300. Viscosity index is measured by ASTM D 2270-04. In one embodiment the viscosity index is between 160 and 250. The high viscosity index is attributable to the high viscosity index of the Group III base oil used in the lubricating oil.

The lubricating oil of this invention comprises a kinematic viscosity at 40° C. from 19.8 cSt to 748 cSt. Kinematic viscosity is measured by ASTM D 445-04.

The oxidation stability of the fully formulated lubricating oil, as compared to the Group III base oil, is measured using the rotary pressure vessel oxidation test by ASTM D 2272-02 (RPVOT). This test method utilizes an oxygen-pressured vessel to evaluate the oxidation stability of new and in-service fully formulated lubricating oils, and other finished lubricants, in the presence of water and a copper catalyst coil at 150° C. The lubricating oil of this invention has a RPVOT result of greater than 600 minutes, preferably greater than 680 or 700 minutes, more preferably greater than 800 minutes, and most preferably greater than 900 minutes.

The oxidation stability of the lubricating oil of this invention may also be measured by the Turbine Oil Stability Test (TOST), by ASTM D 943-04a. The TOST measures an oil's resistance to oxidation and acid formation in the presence of water, oxygen, and metal catalysts in a bath at 95° C. The test endpoint is determined when the acid number of the oil reaches 2.0 mg KOH/gram of oil or the hours in the test reaches 10,000 hours, whichever comes first. The TOST results are reported in hours. The TOST results of the lubricating oils of this invention are preferably greater than 10,000 hours.

In preferred embodiments the lubricating oil of this invention additionally comprises an air release by ASTM D 3427-03 of less than 0.8 minutes at 50° C., or additionally comprises a Pass result in the Procedure B rust test by ASTM D 665-03.

Hydraulic Fluid:

The hydraulic fluids of this invention containing a zinc antiwear (AW) hydraulic fluid additive package are premium hydraulic oils designed to meet all major pump manufacturers' requirements for protection of hydraulic pumps. The oils demonstrate high oxidation stability, yielding dramatically longer service life than conventional hydraulic fluids. Metal-to-metal contact is kept to a minimum as required by all anti-wear hydraulic fluids, helping extend equipment life. These oils are designed for use in vane-, piston-, and gear-type pumps and perform especially well in cases where hydraulic pressures exceed 1000 psi.

The hydraulic fluids of this invention containing an ashless antiwear additive package are zinc-free oils formulated to meet or exceed the performance requirements of conventional anti-wear fluids while providing an additional level of environmental safety. All grades meet the requirements of Denison HF-0, while ISO 32 and 46 meet the requirements of Cincinnati Milacron P-68 and P-70, respectively. ISO 68 meets the requirements of Cincinnati Milacron P-69. ISO 46 meets both the Vickers anti-wear requirements of M-2950-S for mobile hydraulic systems and 1-286-S for industrial hydraulic systems. Chevron Clarity Hydraulic Oils AW are inherently biodegradable and pass the EPA's acute aquatic toxicity (LC-50) test. These oils have substantially better oxidation stability than conventional hydraulic fluids.

The hydraulic fluids of this invention containing an ashless antiwear additive package are designed for use in the vane-, piston-, and gear-type pumps of mobile and stationary hydraulic equipment in environmentally sensitive areas. They are especially well suited for applications that exceed 5000 psi as found in axial piston pumps.

Circulating Oil:

Turbine oils and paper machine oils, for example, belong to the general class of circulating oils. Rust and oxidation inhibited (R&O), antiwear (AW) and extreme pressure (EP) oils are all circulating oils.

The circulating oils of this invention are in one embodiment paper machine oils that are highly useful in paper machine circulating systems, dryer bearings, and calender stacks. They preferably meet or exceed the specifications of paper machine equipment manufacturers, including Valmet, Beloit, and Voith Sulzer.

The circulating oils containing a zinc antiwear additive package with a viscosity grade of ISO 150, ISO 220, and ISO 320 may be used as AGMA R&O Oils 4, 5, and 6, respectively, for enclosed gear drives. The ISO 220 and 320 viscosity grades of the circulating oils containing a zinc antiwear additive package may also be used in plain and antifriction bearings at elevated ambient temperatures as high as 80° C. (175° F.).

The circulating oils of this invention containing an ashless antiwear additive package; with a viscosity grade of ISO 100, ISO 150, ISO 220, ISO 320 and 460 may be used as AGMA 3EP, 4EP, 5EP, 6EP and 7EP oils respectively. They are suitable for back-side gears and enclosed gear drives. The circulating oils of this invention containing an ashless antiwear additive package exhibit outstanding oxidation stability and yield gear-oil-like EP characteristics. They also have superior wet filterability, as demonstrated by the Pall Filterability Test. The circulating oils of this invention containing an ashless antiwear additive package are recommended for use in all circulating systems of paper machines, including wet-end systems, dryer bearings, and calendar stacks. ISO 220 and 320 may also be used in plain and anti-friction bearings.

Turbine Oil:

Turbine oils belong to the subsets of either R&O or EP type circulating oils. Because of their excellent oxidation stability, most turbine oils are considered high-quality R&O oils. Turbine oils typically have a kinematic viscosity of 28.8 to 110 cSt at 40° C. They are usually ISO 22, ISO 32, ISO 46, ISO 68, or ISO 100 viscosity grades. Turbine oils use different additive packages than hydraulic fluids and other circulating oils such as paper machine oils. All of the turbine oil additive packages include an antioxidant concentrate. The preferred turbine oil additive packages to use are those that are optimized for Group II and Group III base oils. Turbine oil additive packages are available commercially from additive manufacturers, including Chevron Oronite, Ciba Specialty Chemicals, Lubrizol, and Infineum. According to turbine OEMs, oxidation stability is the most important property of turbine oils. The rotary pressure vessel oxidation test (RVPOT by ASTM D 2272-02), and the Turbine Oil Stability test (TOST by ASTM D 943-04a) are the most common oxidation tests cited by turbine manufacturers. The turbine oils of this invention have oxidation stabilities, exceeding those of earlier turbine oils made with Group II oils. In preferred embodiments the turbine oils of this invention will have results in the rotary pressure vessel oxidation test by ASTM D 2272-02 at 150° C. greater than 1300 minutes.

Group I, II and III Base Oils:

Group I, II, and III base oils are defined in API Publication 1509. In the context of this disclosure Group III base oils are base oils that have greater than 90 wt % saturates, less than 10 wt % aromatics, a viscosity index greater than 120 and less than 0.03 wt % sulfur. The preferred Group III base oils of this invention also have a sequential number of carbon atoms. Group III base oils are different from Group IV and Group V base oils, which are defined separately in API Publication 1509. The Group III base oils used in the lubricating oil of this invention are made from a waxy feed. The waxy feed useful in the practice of this invention will generally comprise at least 40 weight percent n-paraffins, preferably greater than 50 weight percent n-paraffins, and more preferably greater than 60 weight percent n-paraffins. The weight percent n-paraffins is typically determined by gas chromatography, such as described in detail in U.S. patent application Ser. No. 10/897,906, filed Jul. 22, 2004, incorporated by reference. The waxy feed may be a conventional petroleum derived feed, such as, for example, slack wax, or it may be derived from a synthetic feed, such as, for example, a feed prepared from a Fischer-Tropsch synthesis. A major portion of the feed should boil above 650° F. Preferably, at least 80 weight percent of the feed will boil above 650° F., and most preferably at least 90 weight percent will boil above 650° F. Highly paraffinic feeds used in carrying out the invention typically will have an initial pour point above 0° C., more usually above 10° C.

The terms "Fischer-Tropsch derived" or "FT derived" means that the product, fraction, or feed originates from or is produced at some stage by a Fischer-Tropsch process. The feedstock for the Fischer-Tropsch process may come from a wide variety of hydrocarbonaceous resources, including natural gas, coal, shale oil, petroleum, municipal waste, derivatives of these, and combinations thereof.

Slack wax can be obtained from conventional petroleum derived feedstocks by either hydrocracking or by solvent refining of the lube oil fraction. Typically, slack wax is recovered from solvent dewaxing feedstocks prepared by one of these processes. Hydrocracking is usually preferred because hydrocracking will also reduce the nitrogen content to a low value. With slack wax derived from solvent refined oils, deoiling may be used to reduce the nitrogen content. Hydrotreating of the slack wax can be used to lower the nitrogen and sulfur content. Slack waxes posses a very high viscosity index, normally in the range of from about 140 to 200, depending on the oil content and the starting material from which the slack wax was prepared. Therefore, slack waxes are suitable for the preparation of Group III base oils having a very high viscosity index.

The waxy feed useful in this invention preferably has less than 25 ppm total combined nitrogen and sulfur. Nitrogen is measured by melting the waxy feed prior to oxidative combustion and chemiluminescence detection by ASTM D 4629-96. The test method is further described in U.S. Pat. No. 6,503,956, incorporated herein. Sulfur is measured by melting the waxy feed prior to ultraviolet fluorescence by ASTM D 5453-00. The test method is further described in U.S. Pat. No. 6,503,956, incorporated herein.

Waxy feeds useful in this invention are expected to be plentiful and relatively cost competitive in the near future as large-scale Fischer-Tropsch synthesis processes come into production. Syncrude prepared from the Fischer-Tropsch process comprises a mixture of various solid, liquid, and gaseous hydrocarbons. Those Fischer-Tropsch products which boil within the range of lubricating base oil contain a high proportion of wax which makes them ideal candidates for processing into Group III base oil. Accordingly, Fischer-Tropsch wax represents an excellent feed for preparing high quality Group III base oils according to the process of the invention. Fischer-Tropsch wax is normally solid at room temperature and, consequently, displays poor low temperature properties, such as pour point and cloud point. However, following hydroisomerization of the wax, Fischer-Tropsch derived Group III base oils having excellent low temperature properties may be prepared. A general description of suitable hydroisomerization dewaxing processes may be found in U.S. Pat. Nos. 5,135,638 and 5,282,958; and US Patent Application 20050133409, incorporated herein.

The hydroisomerization is achieved by contacting the waxy feed with a hydroisomerization catalyst in an isomerization zone under hydroisomerizing conditions. The hydroisomerization catalyst preferably comprises a shape selective intermediate pore size molecular sieve, a noble metal hydrogenation component, and a refractory oxide support. The shape selective intermediate pore size molecular sieve is preferably selected from the group consisting of SAPO-11, SAPO-31, SAPO-41, SM-3, ZSM-22, ZSM-23, ZSM-35, ZSM-48, ZSM-57, SSZ-32, offretite, ferrierite, and combinations thereof. SAPO-11, SM-3, SSZ-32, ZSM-23, and combinations thereof are more preferred. Preferably the noble metal hydrogenation component is platinum, palladium, or combinations thereof.

The hydroisomerizing conditions depend on the waxy feed used, the hydroisomerization catalyst used, whether or not the catalyst is sulfided, the desired yield, and the desired properties of the Group III base oil. Preferred hydroisomerizing conditions useful in the current invention include temperatures of 260° C. to about 413° C. (500 to about 775° F.), a total pressure of 15 to 3000 psig, and a hydrogen to feed ratio from about 0.5 to 30 MSCF/bbl, preferably from about 1 to about 10 MSCF/bbl, more preferably from about 4 to about 8 MSCF/bbl. Generally, hydrogen will be separated from the product and recycled to the isomerization zone.

Optionally, the Group III base oil produced by hydroisomerization dewaxing may be hydrofinished. The hydrofinishing may occur in one or more steps, either before or after fractionating of the Group III base oil into one or more fractions. The hydrofinishing is intended to improve the oxidation stability, UV stability, and appearance of the product by removing aromatics, olefins, color bodies, and solvents. A general description of hydrofinishing may be found in U.S. Pat. Nos. 3,852,207 and 4,673,487, incorporated herein. The hydrofinishing step may be needed to reduce the weight percent olefins in the Group III base oil to less than 10, preferably less than 5, more preferably less than 1, and most preferably less than 0.5. The hydrofinishing step may also be needed to reduce the weight percent aromatics to less than 0.1, preferably less than 0.05, more preferably less than 0.02, and most preferably less than 0.01.

The Group III base oil is fractionated into different viscosity grades of base oil. In the context of this disclosure "different viscosity grades of base oil" is defined as two or more base oils differing in kinematic viscosity at 100° C. from each other by at least 1.0 cSt. Kinematic viscosity is measured using ASTM D 445-04. Fractionating is done using a vacuum distillation unit to yield cuts with pre selected boiling ranges.

The Group III base oil fractions will typically have a pour point less than 0° C. Preferably the pour point will be less than −10° C. Additionally, in some embodiments the pour point of the Group III base oil fraction will have a ratio of pour point, in degrees C., to the kinematic viscosity at 100° C., in cSt, greater than a Base Oil Pour Factor, where the Base Oil Pour Factor is defined by the equation: Base Oil Pour Factor=7.35× Ln(Kinematic Viscosity at 100° C.)−18. Pour point is measured by ASTM D 5950-02.

The Group III base oil fractions have measurable quantities of unsaturated molecules measured by FIMS. In a preferred embodiment the hydroisomerization dewaxing and fractionating conditions in the process of this invention are tailored to produce one or more selected fractions of base oil having greater than 20 weight percent total molecules with cycloparaffinic functionality, preferably greater than 35 or greater than 40; and a viscosity index greater than 150. The one or more selected fractions of Group III base oils will usually have less than 70 weight percent total molecules with cycloparaffinic functionality. Preferably the one or more selected fractions of Group III base oil will additionally have a ratio of molecules with monocycloparaffinic functionality to molecules with multicycloparaffinic functionality greater than 2.1. In preferred embodiments there may be no molecules with multicycloparaffinic functionality, such that the ratio of molecules with monocycloparaffinic functionality to molecules with multicycloparaffinic functionality is greater than 100.

The presence of predominantly cycloparaffinic molecules with monocycloparaffinic functionality in the Group III base oil fractions of this invention provides excellent oxidation stability, low Noack volatility, as well as desired additive solubility and elastomer compatibility. The Group III base oil fractions have a weight percent olefins less than 10, preferably less than 5, more preferably less than 1, and most preferably less than 0.5. The Group III base oil fractions preferably have a weight percent aromatics less than 0.1, more preferably less than 0.05, and most preferably less than 0.02.

In preferred embodiments, the Group III base oil fractions have a traction coefficient less than 0.023, preferably less than or equal to 0.021, more preferably less than or equal to 0.019, when measured at a kinematic viscosity of 15 cSt and at a slide to roll ratio of 40 percent. Preferably they have a traction coefficient less than an amount defined by the equation: traction coefficient=0.009×Ln(Kinematic Viscosity)−0.001, wherein the Kinematic Viscosity during the traction coefficient measurement is between 2 and 50 cSt; and wherein the traction coefficient is measured at an average rolling speed of 3 meters per second, a slide to roll ratio of 40 percent, and a load of 20 Newtons. Examples of these preferred base oil fractions are taught in U.S. Patent Publication Number US20050241990A1, filed Apr. 29, 2004.

In preferred embodiments, where the olefin and aromatics contents are significantly low in the lubricant base oil fraction of the lubricating oil, the Oxidator BN of the selected Group III base oil fraction will be greater than 25 hours, preferably greater than 35 hours, more preferably greater than 40 or even 41 hours. The Oxidator BN of the selected Group III base oil fraction will typically be less than 60 hours. Oxidator BN is a convenient way to measure the oxidation stability of Group III base oils. The Oxidator BN test is described by Stangeland et al. in U.S. Pat. No. 3,852,207. The Oxidator BN test measures the resistance to oxidation by means of a Dornte-type oxygen absorption apparatus. See R. W. Dornte "Oxidation of White Oils," Industrial and Engineering Chemistry, Vol. 28, page 26, 1936. Normally, the conditions are one atmosphere of pure oxygen at 340° F. The results are reported in hours to absorb 1000 ml of $O_2$ by 100 g. of oil. In the Oxidator BN test, 0.8 ml of catalyst is used per 100 grams of oil and an additive package is included in the oil. The catalyst is a mixture of soluble metal naphthenates in kerosene. The mixture of soluble metal naphthenates simulates the average metal analysis of used crankcase oil. The level of metals in the catalyst is as follows: Copper=6,927 ppm; Iron=4,083 ppm; Lead=80,208 ppm; Manganese=350 ppm; Tin=3565 ppm. The additive package is 80 millimoles of zinc bispolypropylenephenyldithio-phosphate per 100 grams of oil, or approximately 1.1 grams of OLOA 260. The Oxidator BN test measures the response of a lubricating base oil in a simulated application. High values, or long times to absorb one liter of oxygen, indicate good oxidation stability.

OLOA is an acronym for Oronite Lubricating Oil Additive®, which is a registered trademark of Chevron Oronite.

The lubricating oil of this invention comprises between 1 and 99.8 weight percent based on the total lubricating oil of the selected Group III base oil fraction. Preferably the amount of selected Group III base oil in the lubricating-oil will be greater than 15 wt %. The lubricating oil of this invention comprises a viscosity grade of ISO 22 up to ISO 680. The ISO viscosity grades are defined by ASTM D 2422-97 (Reapproved 2002).

Antioxidant Additive Concentrate:

The lubricating oil of this invention comprises an antioxidant additive concentrate. Antioxidant additive concentrate is present to minimize and delay the onset of lubricant oxidative degradation. In a preferred embodiment the antioxidant additive concentrate of this invention may comprise one or more hindered phenol oxidation inhibitors. Examples of hindered phenol (phenolic)

oxidation inhibitors include: 2,6-di-tert-butylphenol, 4,4'-methylene-bis(2,6-di-tert-butylphenol), 4,4'-bis(2,6-di-tert-butylphenol), 4,4'-bis(2-methyl-6-tert-butylphenol), 2,2'-methylene-bis(4-methyl-6-tert-butylphenol), 4,4'-butylidene-bis(3-methyl-6-tert-butylphenol), 4,4'-isopropylidene-bis(2,6-di-tert-butylphenol), 2,2'-methylene-bis(4-methyl-6-nonylphenol), 2,2'-isobutylidene-bis(4,6-dimethylphenol), 2,2'-methylene-bis(4-methyl-6-cyclohexylphenol), 2,6-di-tert-butyl-4-methylphenol, 2,6-di-tert-butyl-4-ethylphenol, 2,4-dimethyl-6-tert-butyl-phenol, 2,6-di-tert-1-dimethylamino-p-cresol, 2,6-di-tert-4-(N,N'-dimethylaminomethylphenol), 4,4'-thiobis(2-methyl-6-tert-butylphenol), 2,2'-thiobis(4-methyl-6-tert-butylphenol), bis(3-methyl-4-hydroxy-5-tert-butylbenzyl)-sulfide, and bis(3,5-di-tert-butyl-4-hydroxybenzyl).

Another embodiment of the antioxidant additive concentrate comprises the oxidation inhibitor 2-(4-hydroxy-3,5-di-t-butyl benzyl thiol) acetate, which is available commercially from Ciba Specialty Chemicals at 540 White Plains Road, Terrytown, N.Y. 10591 as IRGANOX L118®, and no other oxidation inhibitor.

Additional or other types of oxidation inhibitors may be used in the antioxidant additive concentrate. Additional oxidation inhibitors may further reduce the tendency of lubricating oils to deteriorate in service. The antioxidant additive concentrate may include but is not limited to contain such oxidation inhibitors as metal dithiocarbamate (e.g., zinc dithiocarbamate), methylenebis (dibutyldithiocarbamate), zinc dialkyldithiophosphate, and diphenylamine. Diphenylamine oxidation inhibitors include, but are not limited to, alkylated diphenylamine, phenyl-.alpha.-naphthylamine, and alkylated-.alpha.-naphthylamine. In some formulations a synergistic effect may be observed between different oxidation inhibitors, such as between diphenylamine and hindered phenol oxidation inhibitors.

Preferred antioxidant additive concentrates are ashless, meaning that they contain no metals. The use of ashless additives reduces deposit formation and has environmental performance advantages. The removal of zinc containing additives in the lubricating oil is especially desired.

The antioxidant additive concentrate may be incorporated into the lubricating oil of this invention in an amount of about 0.01 wt % to about 5 wt %, preferably from about 0.05 wt % to about 5 wt %, more preferably from about 0.05 wt % to about 2.0 wt %, even more preferably from about 0.05 wt % to about 1.0 wt %.

Viscosity Index Improvers (VI Improvers):

VI improvers modify the viscometric characteristics of lubricants by reducing the rate of thinning with increasing temperature and the rate of thickening with low temperatures. VI improvers thereby provide enhanced performance at low and high temperatures. VI improvers are typically subjected to mechanical degradation due to shearing of the molecules in high stress areas. High pressures generated in hydraulic systems subject fluids to shear rates up to $10^7 s^{-1}$. Hydraulic shear causes fluid temperature to rise in a hydraulic system and shear may bring about permanent viscosity loss in lubricating oils.

Generally VI improvers are oil soluble organic polymers, typically olefin homo- or co-polymers or derivatives thereof, of number average molecular weight of about 15000 to 1 million atomic mass units (amu). VI improvers are generally added to lubricating oils at concentrations from about 0.1 to 10 wt %. They function by thickening the lubricating oil to which they are added more at high temperatures than low, thus keeping the viscosity change of the lubricant with temperature more constant than would otherwise be the case. The change in viscosity with temperature is commonly represented by the viscosity index (VI), with the viscosity of oils with large VI (e.g. 140) changing less with temperature than the viscosity of oils with low VI (e.g. 90).

Major classes of VI improvers include: polymers and copolymers of methacrylate and acrylate esters; ethylene-propylene copolymers; styrene-diene copolymers; and polyisobutylene, VI improvers are often hydrogenated to remove residual olefin. VI improver derivatives include dispersant VI improver, which contain polar functionalities such as grafted succinimide groups.

The lubricating oil of the invention has less than 0.5 wt %, preferably less than 0.4 wt %, more preferably less than 0.2 wt % of VI improver. Most preferably the lubricating oil has no VI improver at all.

Specific Analytical Test Methods:

Wt % Olefins:

The Wt % Olefins in the Group III base oils of this invention is determined by proton-NMR by the following steps, A-D:

A. Prepare a solution of 5-10% of the test hydrocarbon in deuterochloroform.

B. Acquire a normal proton spectrum of at least 12 ppm spectral width and accurately reference the chemical shift (ppm) axis. The instrument must have sufficient gain range to acquire a signal without overloading the receiver/ADC. When a 30 degree pulse is applied, the instrument must have a minimum signal digitization dynamic range of 65,000. Preferably the dynamic range will be 260,000 or more.

C. Measure the integral intensities between:

6.0-4.5 ppm (olefin)

2.2-1.9 ppm (allylic)

1.9-0.5 ppm (saturate)

D. Using the molecular weight of the test substance determined by ASTM D 2503, calculate:

1. The average molecular formula of the saturated hydrocarbons
2. The average molecular formula of the olefins
3. The total integral intensity (=sum of all integral intensities)
4. The integral intensity per sample hydrogen (=total integral/number of hydrogens in formula)
5. The number of olefin hydrogens (=Olefin integral/integral per hydrogen)
6. The number of double bonds (=Olefin hydrogen times hydrogens in olefin formula/2)
7. The wt % olefins by proton NMR=100 times the number of double bonds times the number of hydrogens in a typical olefin molecule divided by the number of hydrogens in a typical test substance molecule.

The wt % olefins by proton NMR calculation procedure, D, works best when the % olefins result is low, less than about 15 weight percent. The olefins must be "conventional" olefins; i.e. a distributed mixture of those olefin types having hydrogens attached to the double bond carbons such as: alpha, vinylidene, cis, trans, and trisubstituted. These olefin types will have a detectable allylic to olefin integral ratio between 1 and about 2.5. When this ratio exceeds about 3, it indicates a higher percentage of tri or tetra substituted olefins are present and that different assumptions must be made to calculate the number of double bonds in the sample.

Aromatics Measurement by HPLC-UV:

The method used to measure low levels of molecules with at least one aromatic function in the lubricant base oils of this invention uses a Hewlett Packard 1050 Series Quaternary Gradient High Performance Liquid Chromatography (HPLC) system coupled with a HP 1050 Diode-Array UV-Vis detector interfaced to an HP Chem-station. Identification of the individual aromatic classes in the highly saturated Group III base oils was made on the basis of their UV spectral pattern and their elution time. The amino column used for this analysis differentiates aromatic molecules largely on the basis of their ring-number (or more correctly, double-bond number). Thus, the single ring aromatic containing molecules elute first, followed by the polycyclic aromatics in order of increasing double bond number per molecule. For aromatics with similar double bond character, those with only alkyl substitution on the ring elute sooner than those with naphthenic substitution.

Unequivocal identification of the various base oil aromatic hydrocarbons from their UV absorbance spectra was accomplished recognizing that their peak electronic transitions were all red-shifted relative to the pure model compound analogs to a degree dependent on the amount of alkyl and naphthenic substitution on the ring system. These bathochromic shifts are well known to be caused by alkyl-group delocalization of the electrons in the aromatic ring. Since few unsubstituted aromatic compounds boil in the lubricant range, some degree of red-shift was expected and observed for all of the principle aromatic groups identified.

Quantitation of the eluting aromatic compounds was made by integrating chromatograms made from wavelengths optimized for each general class of compounds over the appropriate retention time window for that aromatic. Retention time window limits for each aromatic class were determined by manually evaluating the individual absorbance spectra of eluting compounds at different times and assigning them to the appropriate aromatic class based on their qualitative similarity to model compound absorption spectra. With few exceptions, only five classes of aromatic compounds were observed in highly saturated API Group II and III lubricant base oils.

HPLC-UV Calibration:

HPLC-UV is used for identifying these classes of aromatic compounds even at very low levels. Multi-ring aromatics typically absorb 10 to 200 times more strongly than single-ring aromatics. Alkyl-substitution also affected absorption by about 20%. Therefore, it is important to use HPLC to separate and identify the various species of aromatics and know how efficiently they absorb.

Five classes of aromatic compounds were identified. With the exception of a small overlap between the most highly retained alkyl-1-ring aromatic naphthenes and the least highly retained alkyl naphthalenes, all of the aromatic compound classes were baseline resolved. Integration limits for the co-eluting 1-ring and 2-ring aromatics at 272 nm were made by the perpendicular drop method. Wavelength dependent response factors for each general aromatic class were first determined by constructing Beer's Law plots from pure model compound mixtures based on the nearest spectral peak absorbances to the substituted aromatic analogs.

For example, alkyl-cyclohexylbenzene molecules in base oils exhibit a distinct peak absorbance at 272 nm that corresponds to the same (forbidden) transition that unsubstituted tetralin model compounds do at 268 nm. The concentration of alkyl-1-ring aromatic naphthenes in base oil samples was calculated by assuming that its molar absorptivity response factor at 272 nm was approximately equal to tetralin's molar absorptivity at 268 nm, calculated from Beer's law plots. Weight percent concentrations of aromatics were calculated by assuming that the average molecular weight for each aromatic class was approximately equal to the average molecular weight for the whole base oil sample.

This calibration method was further improved by isolating the 1-ring aromatics directly from the lubricant base oils via exhaustive HPLC chromatography. Calibrating directly with these aromatics eliminated the assumptions and uncertainties associated with the model compounds. As expected, the isolated aromatic sample had a lower response factor than the model compound because it was more highly substituted.

More specifically, to accurately calibrate the HPLC-UV method, the substituted benzene aromatics were separated from the bulk of the lubricant base oil using a Waters semi-preparative HPLC unit. 10 grams of sample was diluted 1:1 in n-hexane and injected onto an amino-bonded silica column, a 5 cm×22.4 mm ID guard, followed by two 25 cm×22.4 mm ID columns of 8-12 micron amino-bonded silica particles, manufactured by Rainin Instruments, Emeryville, Calif., with n-hexane as the mobile phase at a flow rate of 18 mis/min. Column eluent was fractionated based on the detector response from a dual wavelength UV detector set at 265 nm and 295 nm. Saturate fractions were collected until the 265 nm absorbance showed a change of 0.01 absorbance units, which signaled the onset of single ring aromatic elution. A single ring aromatic fraction was collected until the absorbance ratio between 265 nm and 295 nm decreased to 2.0, indicating the onset of two ring aromatic elution. Purification and separation of the single ring aromatic fraction was made by re-chromatographing the monoaromatic fraction away from the "tailing" saturates fraction which resulted from overloading the HPLC column.

This purified aromatic "standard" showed that alkyl substitution decreased the molar absorptivity response factor by about 20% relative to unsubstituted tetralin.

Confirmation of Aromatics by NMR:

The weight percent of all molecules with at least one aromatic function in the purified mono-aromatic standard was confirmed via long-duration carbon 13 NMR analysis. NMR was easier to calibrate than HPLC UV because it simply measured aromatic carbon so the response did not depend on the class of aromatics being analyzed. The NMR results were translated from % aromatic carbon to % aromatic molecules (to be consistent with HPLC-UV and D 2007) by knowing that 95-99% of the aromatics in highly saturated lubricant base oils were single-ring aromatics.

High power, long duration, and good baseline analysis were needed to accurately measure aromatics down to 0.2% aromatic molecules.

More specifically, to accurately measure low levels of all molecules with at least one aromatic function by NMR, the standard D 5292-99 method was modified to give a minimum carbon sensitivity of 500:1 (by ASTM standard practice E 386). A15-hour duration run on a 400-500 MHz NMR with a 10-12 mm Nalorac probe was used. Acorn PC integration software was used to define the shape of the baseline and consistently integrate. The carrier frequency was changed once during the run to avoid artifacts from imaging the aliphatic peak into the aromatic region. By taking spectra on either side of the carrier spectra, the resolution was improved significantly.

Molecular Composition by FIMS:

The lubricant base oils of this invention were characterized by Field Ionization Mass Spectroscopy (FIMS) into alkanes and molecules with different numbers of unsaturations. The distribution of the molecules in the oil fractions was determined by FIMS. The samples were introduced via solid probe, preferably by placing a small amount (about 0.1 mg.) of the base oil to be tested in a glass capillary tube. The capillary tube was placed at the tip of a solids probe for a mass spectrometer, and the probe was heated from about 40 to 50° C. up to 500 or 600° C. at a rate between 50° C. and 100° C. per minute in a mass spectrometer operating at about $10^{-6}$ torr. The mass spectrometer was scanned from m/z 40 to m/z 1000 at a rate of 5 seconds per decade.

The mass spectrometers used was a Micromass Time-of-Flight. Response factors for all compound types were assumed to be 1.0, such that weight percent was determined from area percent. The acquired mass spectra were summed to generate one "averaged" spectrum.

The lubricant base oils of this invention were characterized by FIMS into alkanes and molecules with different numbers of unsaturations. The molecules with different numbers of unsaturations may be comprised of cycloparaffins, olefins, and aromatics. If aromatics were present in significant amounts in the lubricant base oil they would be identified in the FIMS analysis as 4-unsaturations. When olefins were present in significant amounts in the lubricant base oil they would be identified in the FIMS analysis as 1-unsaturations. The total of the 1-unsaturations, 2-unsaturations, 3-unsaturations, 4-unsaturations, 5-unsaturations, and 6-unsaturations from the FIMS analysis, minus the wt % olefins by proton NMR, and minus the wt % aromatics by HPLC-UV is the total weight percent of molecules with cycloparaffinic functionality in the lubricant base oils of this invention. Note that if the aromatics content was not measured, it was assumed to be less than 0.1 wt % and not included in the calculation for total weight percent of molecules with cycloparaffinic functionality.

Molecules with cycloparaffinic functionality mean any molecule that is, or contains as one or more substituents, a monocyclic or a fused multicyclic saturated hydrocarbon group. The cycloparaffinic group may be optionally substituted with one or more substituents. Representative examples include, but are not limited to, cyclopropyl, cyclobutyl, cyclopentyl, cyclohexyl, cycloheptyl, decahydronaphthalene, octahydropentalene, (pentadecan-6-yl)cyclohexane, 3,7,10-tricyclohexylpentadecane, decahydro-1-(pentadecan-6-yl) naphthalene, and the like.

Molecules with monocycloparaffinic functionality mean any molecule that is a monocyclic saturated hydrocarbon group of three to seven ring carbons or any molecule that is substituted with a single monocyclic saturated hydrocarbon group of three to seven ring carbons. The cycloparaffinic group may be optionally substituted with one or more substituents. Representative examples include, but are not limited to, cyclopropyl, cyclobutyl, cyclopentyl, cyclohexyl, cycloheptyl, (pentadecan-6-yl)cyclohexane, and the like.

Molecules with multicycloparaffinic functionality mean any molecule that is a fused multicyclic saturated hydrocarbon ring group of two or more fused rings, any molecule that is substituted with one or more fused multicyclic saturated hydrocarbon ring groups of two or more fused rings, or any molecule that is substituted with more than one monocyclic saturated hydrocarbon group of three to seven ring carbons. The fused multicyclic saturated hydrocarbon ring group preferably is of two fused rings. The cycloparaffinic group may be optionally substituted with one or more substituents. Representative examples include, but are not limited to, decahydronaphthalene, octahydropentalene, 3,7,10-tricyclohexylpentadecane, decahydro-1-(pentadecan-6-yl) naphthalene, and the like.

Method to Improve Lubricating Oil Oxidation Stability:

We discovered a method for improving the oxidation stability of a lubricating oil by replacing a portion of the original base oil in a lubricating oil formulation with the desired base oil of this invention. The desired base oil of this invention has greater than 90 wt % saturates, less than 10 wt % aromatics, a viscosity index greater than 120, less than 0.03 wt % sulfur, a sequential number of carbon atoms, greater than 35 wt % total molecules with cycloparaffinic functionality, and a ratio of molecules with monocycloparaffinic functionality to molecules with multicycloparaffinic functionality greater than 2.1. The original base oil that is being replaced may be selected from the group of Group I, Group II, other Group III, polyalphaolefin, polyinternal olefin, and mixtures thereof. Examples of other Group III base oils are Chevron 4R, Chevron 7R, ExxonMobil VISOM, Shell XHVI 4.0, Shell XHVI 5.2, Nexbase 3043, Nexbase 3050, Yubase 4, Yubase 6, and PetroCanada 4, 6, and 8.

When a portion of the original base oil is replaced with the desired base oil of this invention the RPVOT test result is increased by at least 25 minutes, preferably by at least 50 minutes, more preferably by at least 100 minutes, and most preferably by at least 150 minutes. Additionally, the viscosity index may be increased. Preferably the viscosity index will be increased by at least 10, but it may be increased by at least 25, or even at least 50. In preferred embodiments the lubricating oil will also improve in air release, and may have an air release by ASTM D 4327-03 of less than 0.8 minutes at 50° C.

A portion of the original base oil in the context of this invention is between 1 and 100 wt %, preferably between 20 and 100%, and most preferably greater than 50 wt %.

EXAMPLES

Example 1

A hydrotreated cobalt based Fischer-Tropsch wax had the following properties:

TABLE I

| Properties | |
|---|---|
| Nitrogen, ppm | <0.2 |
| Sulfur, ppm | <6 |
| n-paraffin by GC, wt % | 76.01 |

Two base oils, FT-7.3 and FT-14, were made from the hydrotreated cobalt based Fischer-Tropsch wax by hydroisomerization dewaxing, hydrofinishing, fractionating, and blending to a viscosity target. The base oils had the properties as shown in Table II.

TABLE II

| Sample Properties | FT-7.3 | FT-14 |
|---|---|---|
| Viscosity at 100° C., cSt | 7.336 | 13.99 |
| Viscosity Index | 165 | 157 |
| Pour Point, ° C. | −20 | −8 |
| SIMDIST (wt %), ° F. | | |
| 5 | 742 | 963 |
| 10/30 | 777/858 | 972/1006 |
| 50 | 906 | 1045 |

TABLE II-continued

| Sample Properties | FT-7.3 | FT-14 |
|---|---|---|
| 70/90 | 950/995 | 1090/1168 |
| 95 | 1011 | 1203 |
| Total Wt % Aromatics | 0.02819 | 0.04141 |
| Wt % Olefins | 4.45 | 3.17 |
| FIMS, Wt % | | |
| Alkanes | 72.8 | 59.0 |
| 1-Unsaturations | 27.2 | 40.2 |
| 2- to 6-Unsaturations | 0.0 | 0.8 |
| Total | 100.0 | 100.0 |
| Total Molecules with Cycloparaffinic Functionality | 22.7 | 37.8 |
| Ratio of Monocycloparaffins to Multicycloparaffins | >100 | 46.3 |
| Oxidator BN, hours | 24.08 | 18.89 |

FT-14 is an example of the base oil useful in the lubricating oils of this invention. It has greater than 35 wt % total molecules with cycloparaffinic functionality and a high viscosity index.

Example 2

Two blends of ISO 46 hydraulic fluid using the FT-7.3 and the FT-14 were blended with a commercial liquid zinc anti-wear (AW) hydraulic fluid additive package. The hydraulic fluid additive package comprised liquid antioxidant additive concentrate in combination with other additives. No viscosity index improver was added to either of the two blends. The formulations of these two hydraulic fluid blends are summarized in Table III.

TABLE III

| Component, Wt % | HYDA | HYDB |
|---|---|---|
| Hydraulic Fluid AW Additive Package | 0.73 | 0.73 |
| FT-7.3 | 81.55 | 83.53 |
| FT-14 | 17.52 | 15.54 |
| PMA PPD | 0.20 | 0.20 |
| Viscosity Index Improver | 0.00 | 0.00 |
| Total | 100.00 | 100.00 |

The properties of these two different hydraulic fluid blends are shown in Table IV.

TABLE IV

| Properties | HYDA | HYDB |
|---|---|---|
| Viscosity at 40° C. cSt | 43.7 | 43.7 |
| Viscosity Index | 163 | 163 |
| RPVOT@150° C., Minutes to 25 PSI Drop | 608 | 610 |
| TORT B Rust | Pass | |
| Cu Strip Corrosion@100° C. for 3 Hours | 1b | |
| Air Release (D 3427) at 50° C. | 1.8 | |

Both HYDA and HYDB are examples of the lubricating oil of this invention with very high oxidation stability and high VI. The high VI was achieved without any viscosity index improver because of the unique quality of the base oils used. It is surprising that the oxidation stabilities by the RPVOT test were as high as they were considering that the base oils that were used had relatively high olefin contents, and Oxidator BNs of less than 25 hours.

Example 3

Three comparative blends were made using conventional Group I or Group II base oils, either with or without the addition of viscosity index improver or seal swell agent and using the same commercial liquid zinc AW hydraulic fluid additive package as the blends described in Example 2. The formulations of these comparison blends are summarized in Table V.

TABLE V

| Component, Wt % | Comp. HYDC | Comp. HYDD | Comp. HYDE |
|---|---|---|---|
| Hydraulic Fluid AW Additive Package | 0.73 | 0.73 | 0.73 |
| Group I Base Oil | 99.17 | 0.00 | 0.00 |
| Group II Base Oil | 0.00 | 99.07 | 93.16 |
| PMA PPD | 0.10 | 0.20 | 0.20 |
| Viscosity Index Improver | 0.00 | 0.00 | 5.11 |
| Seal Swell Agent | 0.00 | 0.00 | 0.80 |
| Total | 100.00 | 100.00 | 100.00 |

The properties of these three different comparative hydraulic fluid blends are shown in Table VI.

TABLE VI

| Properties | Comp. HYDC | Comp. HYDD | Comp. HYDE |
|---|---|---|---|
| Viscosity at 40° C. cSt | 43.7 | 43.4 | 43.7 |
| Viscosity Index | 99 | 100 | 158 |
| RPVOT@150° C., Minutes to 25 PSI Drop | 317 | 483 | 346 |

These comparative base oils made using different base oils did not have the desired high VI and excellent oxidation stabilities of the lubricating oils of this invention. Although the addition of viscosity index improver in Comp. HYDE improved the viscosity index, the RPVOT was still well below 600 minutes.

Note that by replacing the Group II base oil used in Comparative HYDD with the preferred Group III base oils of this invention (see HYDB) we were able to increase the result in the RPVOT test by more than 100 minutes. Additionally, the viscosity index of the hydraulic fluid was increased by more than 50, without the addition of any viscosity index improver.

Example 4

Two base oils, FT-7.6 and FT-13.1, were made from a 50/50 mix of Luxco 160 petroleum-based wax and Moore & Munger C80 Fe-based FT wax. The 50/50 mix of waxes had about 65.5 wt % n-paraffin, about 2 ppm nitrogen, and less than 4 ppm sulfur. The processes used to make the base oils were hydroisomerization dewaxing, hydrofinishing, fractionating, and blending to a viscosity target. The base oils had the properties as shown in Table VII.

TABLE VII

| Sample Properties | FT-7.6 | FT-13.1 |
|---|---|---|
| Viscosity at 100° C., cSt | 7.597 | 13.14 |
| Viscosity Index | 162 | 152 |
| Pour Point, ° C. | −13 | −4 |
| SIMDIST (wt %), ° F. | | |
| 5 | 778 | 953 |
| 10/30 | 862/902 | 974/1007 |
| 50 | 934 | 1036 |
| 70/90 | 972/1026 | 1061/1106 |
| 95 | 1056 | 1140 |
| Total Wt % Aromatics | 0.01683 | 0.04927 |
| Wt % Olefins | 0.0 | 0.0 |
| FIMS, Wt % | | |
| Alkanes | 58.3 | 42.7 |
| 1-Unsaturations | 34.4 | 39.4 |
| 2- to 6-Unsaturations | 7.3 | 17.9 |
| Total | 100.0 | 100.0 |
| Total Molecules with Cycloparaffinic Functionality | 41.7 | 57.3 |
| Ratio of Monocycloparaffins to Multicycloparaffins | 4.7 | 2.2 |
| Oxidator BN, hours | 45.42 | 33.52 |

Both FT-7.6 and FT-13.1 are examples of the preferred base oils used in this invention. Both of them have greater than 35 wt % total molecules with cycloparaffinic functionality and viscosity indexes greater than 150. Both of them were derived from a waxy feed having greater than 60 wt % n-paraffin and less than 25 ppm total combined nitrogen and sulfur. Additionally, both of these base oils had very low aromatics and olefins, which also contributed to higher oxidation stability. They both had Oxidator BNs between 25 and 60 hours. FT-7.6 is an especially preferred Group III base oil as it has a viscosity index greater than 150 and an Oxidator BN greater than 45 hours. If one of these oils were used to replace a Group I, Group II, or Group III base oil having a viscosity index less than 130 in a lubricating oil formulation the RPVOT result could increase by greater than 150 minutes and the viscosity index could increase by more than 50, without the addition of any other additives or viscosity index improver.

Example 5

Two blends of ISO 46 hydraulic fluid (HYDF and HYDG) and one blend of ISO 68 (HYDH) hydraulic fluid using the FT-7.6 and the FT-13.1 were blended with the same commercial liquid zinc AW hydraulic fluid additive package used in Examples 2 and 3. No viscosity index improver was added to either of the three blends. The formulations of these three hydraulic fluid blends are summarized in Table VII.

TABLE VII

| Component, Wt % | HYDF | HYDG | HYDH |
|---|---|---|---|
| Hydraulic Fluid AW Additive Package | 0.73 | 0.73 | 0.73 |
| FT-7.6 | 88.94 | 90.00 | 36.05 |
| FT-13.1 | 10.13 | 8.87 | 63.02 |
| PMA PPD | 0.20 | 0.40 | 0.20 |
| Viscosity Index Improver | 0.00 | 0.00 | 0.00 |
| Total | 100.00 | 100.00 | 100.00 |

The properties of these three different hydraulic fluid blends are shown in Table VIII.

TABLE VIII

| Properties | HYDF | HYDG | HYDH |
|---|---|---|---|
| Viscosity at 40° C. cSt | 43.7 | 43.7 | 65.1 |
| Viscosity Index | 162 | 163 | 158 |
| RPVOT@150° C., Minutes to 25 PSI Drop | 690 | 746 | 697 |
| Air Release (D 3427) at 50° C. | 1.06 | 0.67 | 1.75 |

Example 6

A blend of Chevron Clarity® Synthetic Hydraulic Fluid AW ISO 46 using FT-7.6 and FT-13.1 was prepared (HYDJ). An ashless antiwear additive package was used in this blend. The ashless antiwear additive package comprised about 46% liquid antioxidant additive concentrate. The liquid antioxidant additive concentrate comprised a mixture of diphenylamine and high molecular weight hindered phenol antioxidants. No viscosity index improver was added to the blend. A comparative blend of Chevron Clarity® Synthetic Hydraulic Fluid AW ISO 32 using Chevron 4R and Chevron 7R Group III base oils and 4.6 wt % viscosity index improver was also prepared (Comp. HYDK). Chevron 4R and Chevron 7R Group III base oils typically have greater than about 75 wt % total molecules with cycloparaffinic functionality. Unlike the base oils used in the hydraulic fluids of the current invention, they both have ratios of molecules with monocycloparaffinic functionality to molecules with multicycloparaffinic functionality of about 2.1 or less. The formulations of these two hydraulic fluid blends are summarized in Table IX.

Clarity® is a registered trademark of Chevron Products Company.

TABLE IX

| Component, Wt % | HYDJ | Comp. HYDK |
|---|---|---|
| Ashless Hydraulic Fluid AW Additive Package | 0.55 | 0.49 |
| FT-7.6 | 82.61 | 0.00 |
| FT-13.1 | 16.74 | 0.00 |
| Chevron 4R/7R Group III Base Oil | 0.00 | 94.72 |
| PMA PPD | 0.20 | 0.19 |
| Viscosity Index Improver | 0.00 | 4.60 |
| Total | 100.00 | 100.00 |

The properties of these two different hydraulic fluid blends are shown in Table X.

TABLE X

| Properties | HYDJ | Comp. HYDK |
|---|---|---|
| Viscosity at 40° C. cSt | 45.4 | 36.4 |
| Viscosity Index | 162 | 180 |
| RPVOT@150° C., Minutes to 25 PSI Drop | 931 | 678 |

Although the comparative HYDK hydraulic fluid had a very good RPVOT result, it was lower than the result obtained with the hydraulic fluid of our invention, and notably lower than the RPVOT of HYDJ. Note that the Comparative HYDK comprised base oils (Chevron 4R/7R Group II) that did not have viscosity indexes greater than 150, nor did they have a preferred ratio of molecules with monocycloparaffinic functionality to molecules with multicycloparaffinic functionality greater than 2.1 of the preferred base oils used in our invention. Comparative HYDK also comprised a significant amount of viscosity index improver to achieve a viscosity index greater than 155.

Example 7

A blend of Chevron Clarity® Synthetic Paper Machine Oil ISO 220 is made by replacing greater than fifty percent of the polyalphaolefin base oil with a FT derived base oil having the properties as shown in Table XI.

TABLE XI

| Properties | FT Derived Base Oil A |
|---|---|
| Viscosity Index | >160 |
| Traction Coefficient* | <0.021 |
| Wt % Saturates | >99 |
| Wt % Aromatics | <0.05 |
| Wt % Olefins | 0.0 |
| Total Molecules with Cycloparaffinic Functionality | Between 35 and 70 wt % |
| Sulfur, ppm | <2 |
| Nitrogen, ppm | <1 |

*traction coefficient is measured at a kinematic viscosity of 15 cSt and at a slide to roll ratio of 40 percent. The load applied is 20N, corresponding to a Hertzian pressure of 0.83 GPa.

Both the original paper machine oil and the improved paper machine oil contain the same ashless antiwear additive package. A component of the ashless antiwear additive package is an antioxidant additive concentrate. By replacing a significant portion of the base oil in the paper machine oil with the FT Derived Base Oil A the resulting improved paper machine oil has a result in the rotary pressure vessel oxidation test by ASTM D 2272-02 greater than 680 minutes, which is at least 200 minutes greater than the result in the original paper machine oil (475 minutes).

All of the publications, patents and patent applications cited in this application are herein incorporated by reference in their entirety to the same extent as if the disclosure of each individual publication, patent application or patent was specifically and individually indicated to be incorporated by reference in its entirety.

Many modifications of the exemplary embodiments of the invention disclosed above will readily occur to those skilled in the art. Accordingly, the invention is to be construed as including all structure and methods that fall within the scope of the appended claims.

What is claimed is:

1. An ashless lubricating oil, comprising: a base oil having greater than 90 wt % saturates, less than 10 wt % aromatics, a base oil viscosity index greater than 120, sulfur less than 0.03 wt %, and a sequential number of carbon atoms; wherein the ashless lubricating oil has:

a. a lubricating oil viscosity index between 155 and 300;

b. a result of greater than 680 minutes in the rotary pressure vessel oxidation test by ASTM D 2272-02 at 150° C.; and c. a kinematic viscosity at 40° C. from 19.8 cSt to 748 cSt; and wherein the ashless lubricating oil is a hydraulic fluid or a paper machine oil.

2. The ashless lubricating oil of claim 1, wherein the lubricating oil viscosity index is between 160 and 250.

3. The ashless lubricating oil of claim 1, wherein the result in the rotary pressure vessel oxidation test is greater than 700 minutes.

4. The ashless lubricating oil of claim 3, wherein the result in the rotary pressure vessel oxidation test is greater than 800 minutes.

5. The hydraulic fluid of claim 1, wherein the hydraulic fluid has a viscosity grade selected from the group consisting of ISO 32, ISO 46, and ISO 68.

6. The paper machine oil of claim 1, wherein the paper machine oil has a viscosity grade selected from the group consisting of ISO 100, ISO 150, ISO 220) ISO 320, and ISO 460.

7. The ashless lubricating oil of claim 1 additionally having an air release by ASTM D3427-03 of less than 0.8 minutes at 50° C.

8. The ashless lubricating oil of claim 1. additionally having a Pass result in the Procedure B rust test by ASTM D 665-03.

9. The ashless lubricating oil of claim 1, wherein the base oil is Fischer-Tropsch derived.

10. The ashless lubricating oil of claim 1, wherein the ashless lubricating oil has a TOST result of greater than 10,000 hours.

11. An ashless paper machine oil, comprising: a base oil having a sequential number of carbon atoms; wherein the ashless paper machine oil has:

a. a lubricating oil viscosity index between 155 and 300;

b. a result of greater than 680 minutes in the rotary pressure vessel oxidation test by ASTM D 2272-02 at 150° C.; and a kinematic viscosity at 40° C. from 19.8 cSt to 748 cSt.

12. The ashless paper machine oil of claim 11, wherein the base oil has a base oil viscosity index greater than 120.

13. The ashless paper machine oil of claim 11, wherein the base oil is Fischer-Tropsch derived.

14. The ashless paper machine oil of claim 11, wherein the base oil is made from a blend of petroleum-based wax and Fischer-Tropsch derived wax.

15. The ashless paper machine oil of claim 11, wherein the ashless paper machine oil has a viscosity grade that is selected from the group consisting of ISO 100, ISO 150, iSO 220, ISO 320, and ISO 460.

16. The ashless paper machine oil of claim 11, wherein the result in the rotary pressure vessel oxidation test is greater than 700 minutes.

* * * * *